US006422189B1

(12) United States Patent
Pierik

(10) Patent No.: US 6,422,189 B1
(45) Date of Patent: Jul. 23, 2002

(54) MECHANICAL LASH CONTROL APPARATUS FOR AN ENGINE CAM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/874,625

(22) Filed: Jun. 5, 2001

Related U.S. Application Data

(63) Continuation-in-part of application No. 09/755,345, filed on Jan. 5, 2001.

(51) Int. Cl.[7] ..... F01L 1/30; F01L 1/20
(52) U.S. Cl. ..... 123/90.24; 123/90.16
(58) Field of Search ..... 123/90.15, 90.16, 123/90.17, 90.22, 90.24, 90.25, 90.26, 90.31

(56) References Cited

U.S. PATENT DOCUMENTS 3,626,469 A * 12/1971 Ashley ..... 123/90.25
4,928,650 A * 5/1990 Matayoshi et al. ..... 123/90.24
4,944,256 A * 7/1990 Matayoshi et al. ..... 123/90.24
5,048,474 A * 9/1991 Matayoshi et al. ..... 123/90.18
5,937,809 A * 8/1999 Pierik et al. ..... 123/90.16
6,055,949 A * 5/2000 Nakamura et al. ..... 123/90.16

* cited by examiner

*Primary Examiner*—Weilun Lo
(74) *Attorney, Agent, or Firm*—John Van Ophem

(57) ABSTRACT

A rocker arm assembly has a first arm for following a first or opening camshaft lobe, a second arm for following a second or closing camshaft lobe, and a pivot axis of the rocker arm therebetween. A captive roller follower on the first arm follows the first lobe, and a slider on the second arm follows the second lobe. The position of the slider with respect to the roller and to the pivot axis is mechanically and controllably adjustable to optimally set the mechanical lash among these components after installation of the rocker arm assembly into a variable valve mechanism of an internal combustion engine.

3 Claims, 4 Drawing Sheets

MECHANICAL LASH CONTROL APPARATUS FOR AN ENGINE CAM

CROSS REFERENCE TO RELATED APPLICATION

This application is a Continuation-In-Part of a pending U.S. patent application Ser. No. 09/755,345 filed Jan. 5, 2001.

TECHNICAL FIELD

The present invention relates to valve train systems for use on internal combustion engines; more particularly, to devices for controllably varying the lift and/or timing of valves in such engines; and most particularly, to means for controlling the lash between the camshaft lobes and a two-arm rocker arm in a valve train system having cam lobes for both opening and closing an individual valve.

BACKGROUND OF THE INVENTION

Devices for controllably varying the degree of lift and the timing of opening and closing valves in internal combustion engines are well known. See, for example, U.S. Pat. No. 5,937,809 issued Aug. 17, 1999 to Pierik et al., and U.S. Pat. No. 6,019,076 issued Feb. 1, 2000 to Pierik et al., the relevant disclosures of which are herein incorporated by reference. Such a device is referred to in the art as a Variable Valve Mechanism (VVM). Such devices commonly employ a rocker arm which pivots with or about a shaft or pin as a part of the apparatus train. Typically, the rocker arm has a first bearing element, for example a roller, which follows the profile of a cam lobe during rotation of a camshaft.

Conventional variable valve mechanisms typically include many component parts, such as link arms, joints, pins, and return springs, and are thus relatively complex mechanically. Return springs are used typically to maintain the roller in contact with the input cam lobe and to reduce mechanical lash as the input cam lobe rotates from a high lift position to a low lift position. The use of such return springs negatively impacts the durability of the VVM and also may limit the operating range of the mechanisms, thereby limiting the operation of the intake valve throttle control system to a correspondingly-limited range of engine operation.

It is known to provide a second cam lobe per valve in place of return springs, and to employ a two-armed rocker arm sub-assembly having appendages in contact with both the opening lobe and the closing lobe at all times. The angular orientation between the eccentrics of the opening and closing lobes on the camshaft defines the rotational angle through which the valve is open. Typically, the surface of the opening lobe is followed by a roller mounted on the first rocker arm, and the surface of the closing lobe is followed by a slider mounted on the second rocker arm. Such an arrangement provides positive control of the rocker arm sub-assembly, and thus of the associated valve, at all positions of the camshaft and obviates the need for return springs.

A practical problem can arise in manufacturing and assembling such a two-lobe system. The stack-up of machining and mounting tolerances among the rocker, the roller, the pivot shaft for the rocker, the two cam lobes, and the camshaft mounting in the engine head can be formidable. Ideally, the roller and slider are just lightly in contact with the base circles of their respective cam lobes during the non-lift portions of the rotational cycle. If this lash relationship is too tight, i.e., zero or negative clearance, the valve may not open or close properly, or the rocker arm assembly may be stressed and distorted. If the lash relationship is too loose, the rocker arm assembly may clatter or chatter undesirably against the cam lobes, and the valve may not open fully or precisely in time.

What is needed is a simple means whereby the valve train components may be manufactured and assembled with loose tolerances and then the lash relationship of the cam followers to the cam lobes may be easily and precisely adjusted and retained after the valve train is assembled.

It is a principal object of the present invention to provide improved apparatus and method for setting the lash relationship of cam followers to cam lobes in a two-cam, two-follower valve train.

It is a further object of the invention to provide such a system wherein the setting may be conveniently and accurately done after the valve train is assembled.

SUMMARY OF THE INVENTION

Briefly described, a rocker arm assembly in accordance with the invention has a first arm for following a first or opening camshaft lobe and a second arm for following a second or closing camshaft lobe, the arms being designated with respect to a pivot axis of the rocker arm therebetween. Preferably, the first arm is provided with a captive roller follower and the second arm is provided with a captive sliding follower or slider. These elements are so selected for economy because opening of the valve is more mechanically demanding than is closing it. The pivot axis of the rocker arm, the surface of the roller at the contact point with the opening lobe, and the surface of the slider at the contact point with the closing lobe, taken together define a triangle in space which must fit exactly into the space requirements of the valve train assembly of each valve in a multi-cylinder engine. In accordance with the invention, the shape of the triangle is mechanically and controllably adjustable to change the location of the slider with respect to the other two points of the triangle and to the camshaft axis of rotation, to adjustably control the mechanical lash in the system.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
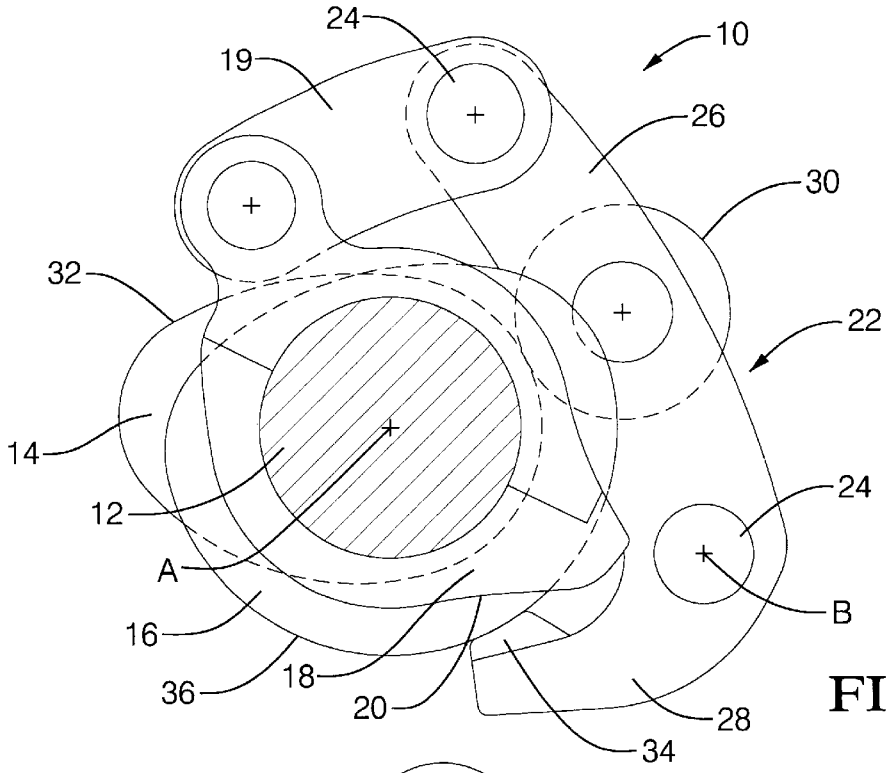
FIG. 1 is an elevational view of a rocker arm assembly for a double-lobe camshaft substantially as disclosed in the parent application, Ser. No. 09/755,345, having some components omitted for clarity, wherein the relative positions of the assembly pivot axis, roller, and slider are fixed and not adjustable.

Referring to FIG. 1, there is shown a portion of a variable valve mechanism 10, including an input camshaft 12 on which are mounted valve-opening cam lobe 14 and valve-closing cam lobe 16. The cam lobes are disposed in a predetermined angular relation relative to each other and relative to central axis A of input shaft 12. The paired lobes 14,16 (only one pair shown) are spaced along the length of input shaft 12. Each respective pair of cam lobes 14,16 is associated with a corresponding variable valve mechanism 10 and with a corresponding cylinder of an internal combustion engine (not shown). For purposes of clarity, a single variable valve mechanism 10 is discussed hereafter.

Opening cam lobe 14 and closing cam lobe 16 rotate as substantially one body with input shaft 12. The lobes are, for example, affixed to or integral with shaft 12 which is received within and extends through bearing mounts disposed on the head of the engine.

Output cam 18 is oscillatably disposed on shaft 12 for actuation of a valve stem, tappet, or roller finger follower (none shown) in known fashion via contact with eccentric surface 20. Cam 18 is pivotably connected to link 19 which is an elongate arm member pivotably coupled at a first end to output cam 18 and at a second and opposite end to rocker assembly 22. Rocker assembly 22 is coupled, for example, by pins 24, to link 19 and to a frame member (omitted for clarity) about which it pivots upon axis B. The frame member may be independently rotated to various positions about shaft 12 to advance or retard the timing of valve opening, as disclosed in the incorporated reference patents. Rocker arm assembly 22 may be thought of as comprising two arms 26,28. First arm 26 carries roller 30 which followingly engages valve-opening cam lobe 14 along eccentric surface 32 and is pivotably pinned to link as discussed above. As shaft 12 and lobe 14 rotate, roller 30 causes assembly 22 to pivot about axis b, thus causing, via link 19, output cam 18 to oscillate about shaft 12.

Rocker assembly 22 further includes a following slider pad 34 disposed on second arm 28 which slidingly engages valve-closing cam lobe 16 along eccentric surface 36. Lobes 14,16 are so shaped and oriented, and arms 26,28 are so oriented with respect to axis B that followers 30,34 are in contact with eccentric surfaces 32,36, respectively at all times during rotation of shaft 12. Thus the action of rocker assembly 22 is fully controlled at all times and does not require use of return springs to assure proper motion. (In practice, the lash adjustment of the system optimally provides for a rest clearance of about 0.001" between slider 34 and surface 36.)

As noted above, there is little room for error in the manufacture and installation of the components shown in FIG. 1, or of the receiving engine head and VVM mounting components as well. Assembly 22 must have roller 30 and slider 34 positioned accurately with respect to axis B such that they just touch surfaces 32,36, respectively. It is a principal object of the invention to provide apparatus and method whereby the position of the slider may be adjusted post-assembly to achieve the required degree of accuracy and optimal amount of lash.

Figure 2:
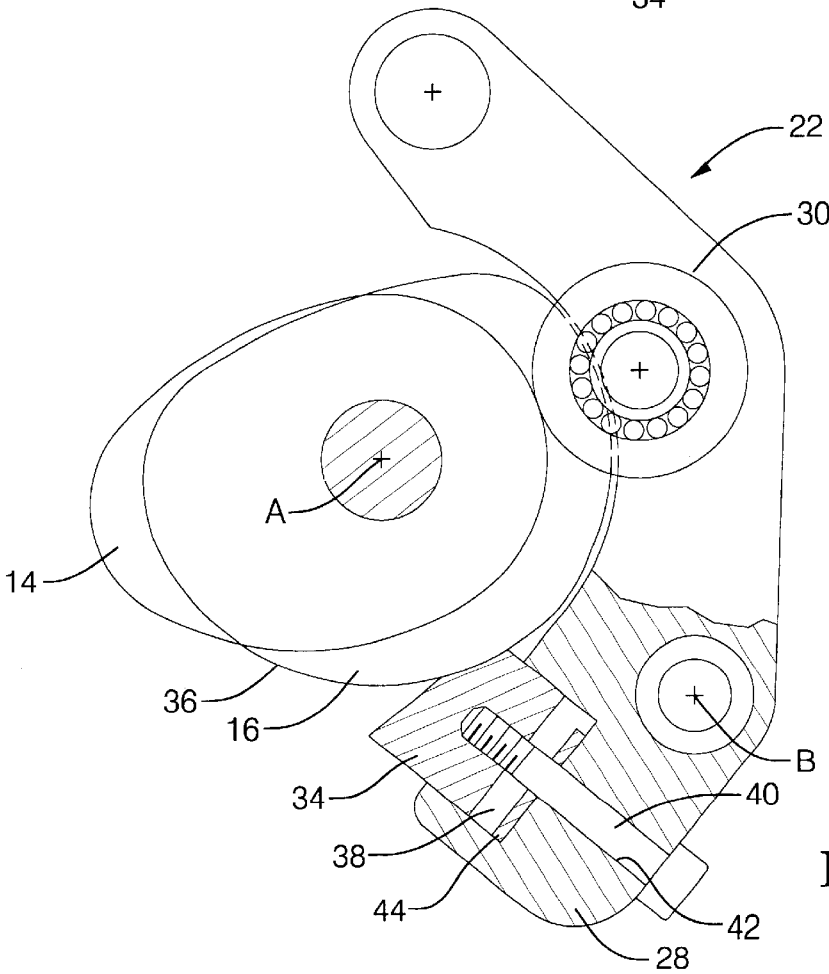
FIGS. 2 through 10 are elevational views of various embodiments of a rocker arm assembly in accordance with the invention, illustrating various means for controllably varying the spacing of the closing-lobe slider to the closing lobe.

Referring to FIG. 2, an improved rocker arm assembly 22 is shown wherein slider 34 is disposed close-fittingly in a well 38 formed in arm 28 and is guided by the walls of the well in motion into and out of the well. A smooth portion of adjustment screw 40 is retained in a smooth bore 42 through arm 28 into well 38 and is retained therein by flange 44. A threaded portion of screw 40 extends into a mating threaded bore in slider 34. Slider 34 may be advanced or retarded with respect to surface 36 by rotation of screw 40. Once the proper position of slider 34 is set, screw 40 may be locked from further rotation by any of various well-known locking means.

Figure 3:
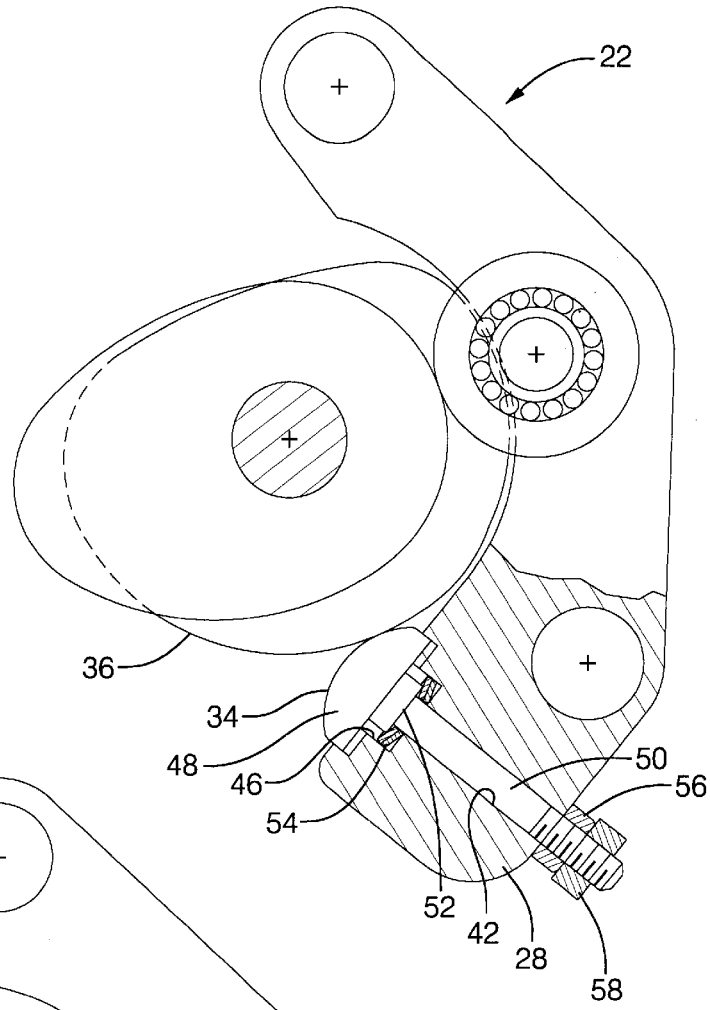

Referring to FIG. 3, in this embodiment, a stepped well 46 is provided in arm 28. Slider 34 has a head portion 48 for engaging surface 36 and a shaft portion 50 extending through bore 42. Head portion 48 is provided with a boss 52 extending into well 46 and engaging belleville washer 54 in the bottom of the well. Shaft portion 50 is threaded where it exits bore 42 opposite well 46. Nut 56 may be rotated to vary the axial position of shaft 50 in bore 42, and thus head portion 48 with respect to surface 36, by using washer 54 as a resistance spring. Once adjusted, the position of nut 56 may be fixed by lock nut 58. An advantage of this embodiment is that the belleville washer can also function as a load-leveling or load-relieving spring as required.

Figure 4:
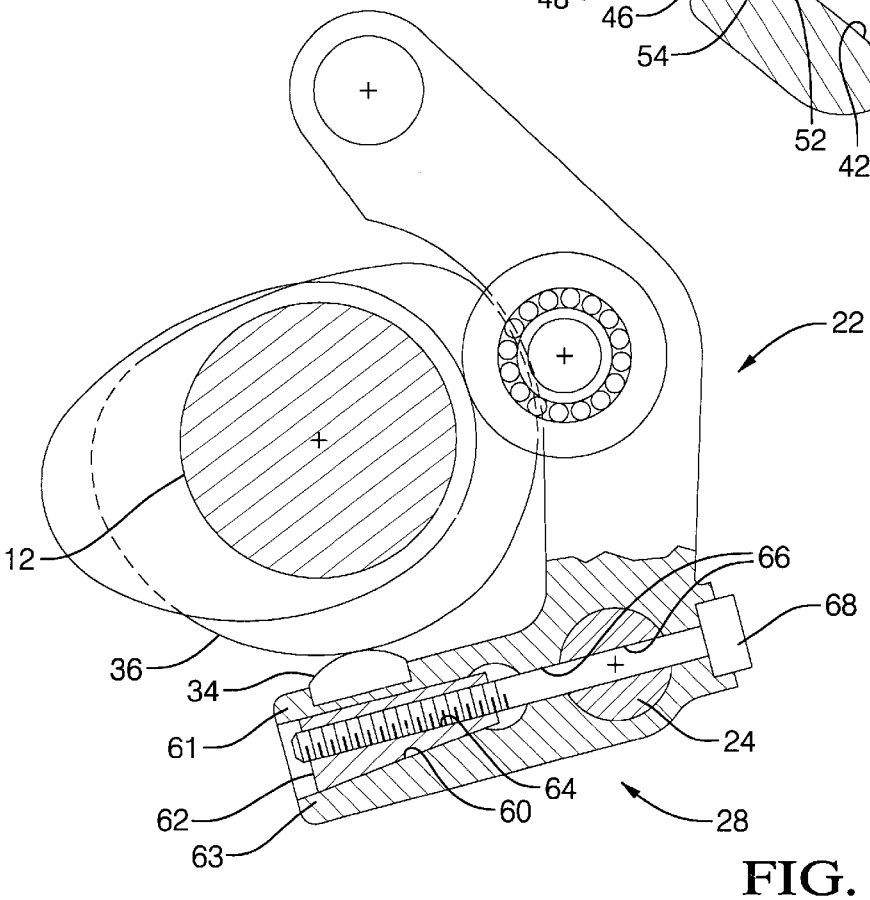

Referring to FIG. 4, in this embodiment, arm 28 is formed having a tapered longitudinal slot 60 having inner 61 and outer 63 jaws receivable of a wedge 62 having a threaded longitudinal bore 64. Preferably, inner jaw 61 is thinner and more flexible than outer jaw 63. A smooth bore 66 extends through the longitudinal remainder of arm 28, as well as through pin 24. A threaded adjustment screw 68 extends through bore 66 and engages wedge 62 along threaded bore 64. Pin 24 is thus rotatably attached to assembly 22 and turns with it. In addition, the screw through the pin retains the pin in the rocker assembly, so no other retaining feature is needed. Rotation of screw 68 acts to drive wedge 62 into or out of slot 60, thereby adjusting the spacing of slider 34 in relation to eccentric surface 36.

Figure 5:
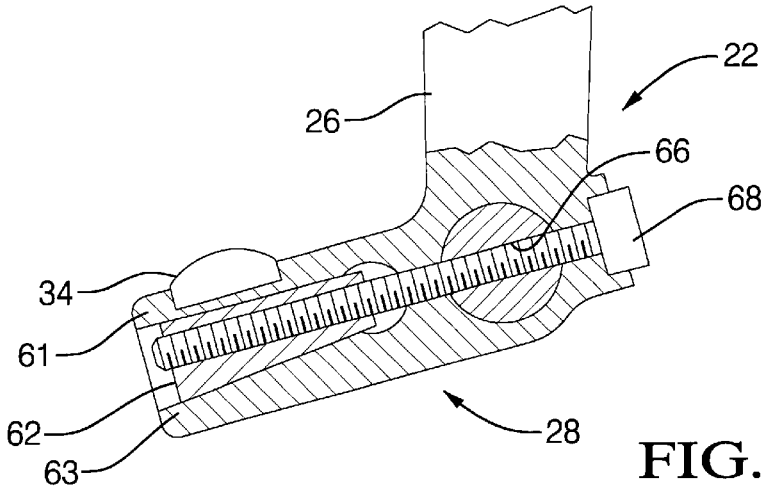

Referring to FIG. 5, this embodiment is similar to that shown in FIG. 4 except that screw 68 is threaded throughout its length. Again, pin 24 is rotationally coupled to rocker assembly 22.

Figure 6:
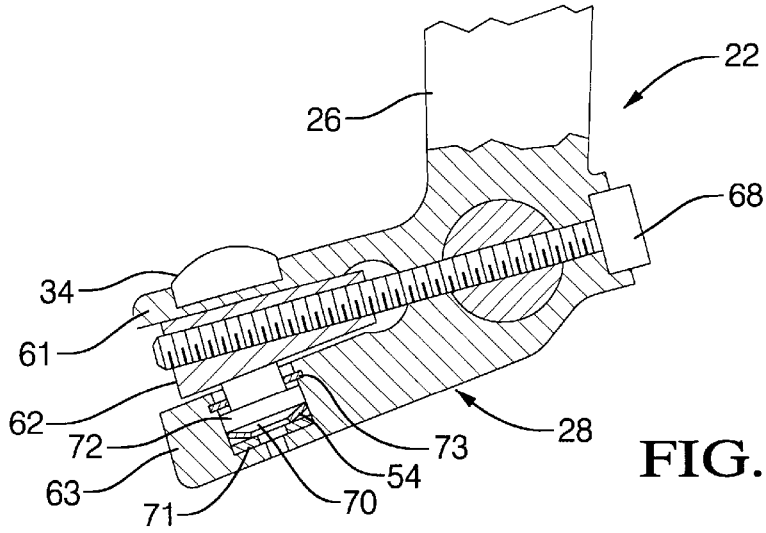

Referring to FIG. 6, this embodiment is similar to the embodiments shown in FIGS. 4 and 5. However, outer jaw 63 is provided with a load-leveling and load-relieving system similar to that shown in FIG. 3. A well 70 in outer jaw 63 is receivable of a piston 72 backed by a belleville washer 54 such that unexpected or transient loads placed on slider 34 may be absorbed by axial compression or extension of washer 54. The overload compensating features are adjustable at assembly by the choice of size of the belleville washer and by insertion of spacers 71 under the washer. Preferably, the belleville washer is preloaded to a predetermined degree by depression of the piston, and the piston is then retained at that degree of preload by a retaining clip 73 disposed in an annular groove in the wall of well 70 above piston 72.

Figure 7:
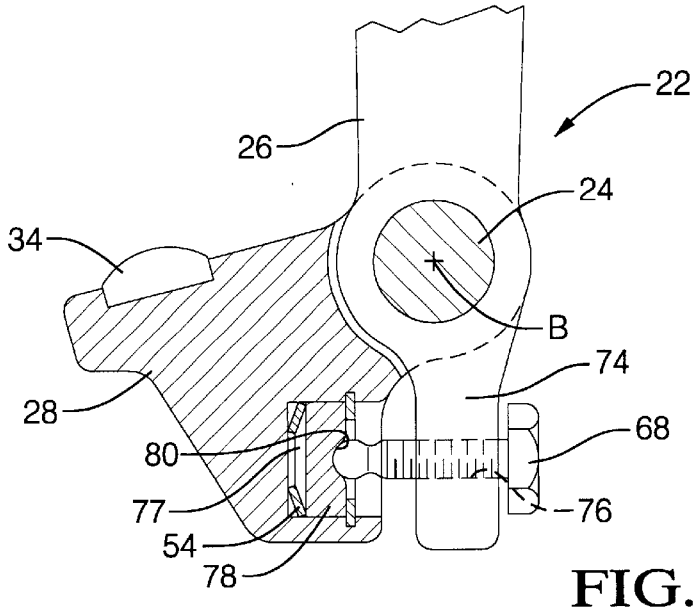

Referring to FIG. 7, in this embodiment, second arm 28 is separate from first arm 26, and both are pivotable on pin 24 about axis B. Arm 26 is provided with an extension 74 extending beyond pin 24 and generally parallel to arm 28 and having a threaded bore 76 therethrough in the direction of arm 28. A well 77 in arm 28 is receivable of a piston 78 and a belleville washer 54 for cushioning the axial motion of piston 78 in well 76, similar to the mechanism disclosed in FIG. 6 and described above. Preferably, piston 78 has a recess 80 in an outer surface thereof for receiving an end of an adjusting screw 68. Rotation of adjusting screw 68 changes the included angle between arms 26 and 28, and thus changes the relation between slider 34 and the valve-closing cam.

Figure 8:
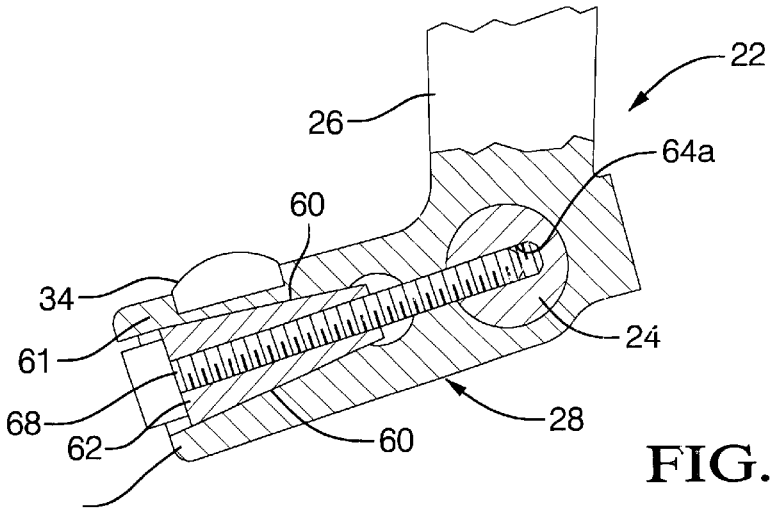
Figure 9:
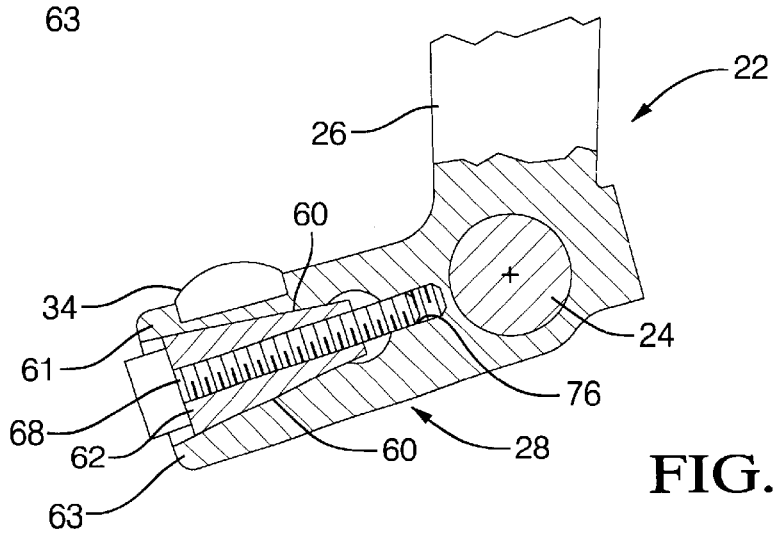
Figure 10:
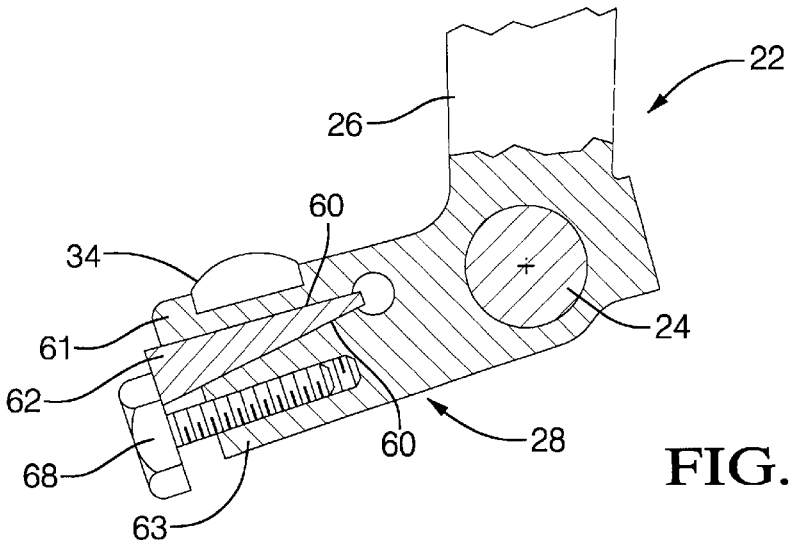

Referring to FIGS. 8 through 10, arm 28 is provided with inner and outer jaws 61,63, respectively, separated by a tapered slot 60.

In the embodiment shown in FIG. 8, a wedge 62 has a longitudinal threaded bore 64, and pin 24 has a corresponding threaded bore **64*a* such that the wedge is drawn into or out of the jaws upon rotation of screw 68, thus moving slider 34 toward or away from cam lobe 16 (not shown). Pin 24 is thus rotationally coupled to rocker assembly 22, as in the embodiments shown in FIGS. 4 and 5**.

In FIG. 9, screw 68 is engaged in a threaded portion 76 of arm 28, and rocker assembly 22 is thus free to rotate about pin 24.

In FIG. 10, wedge 62 is disposed in tapered slot 60 and screw 68 is disposed in an adjacent threaded bore, the head of screw 68 overlapping the butt end of wedge 62. The wedge may be driven into or brought out of the tapered slot via rotation of the screw.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A rocker assembly pivotable about a pivot axis for following a valve-opening cam lobe and a valve-closing cam lobe of a variable valve mechanism in an internal combustion engine, comprising:

a) a first arm;

b) a first follower on said first arm for following said valve-opening cam lobe;

c) a second arm disposed at an included angle from said first arm; and d) a second follower on said second arm for following said valve-closing cam lobe, said second arm having adjustment means whereby said second follower is adjustable toward and away from said valve-closing cam lobe to control mechanical lash in said variable valve mechanism, wherein said adjustment means includes a tapered slot in said second arm defined by inner and outer jaws, and a wedge slidably disposed in said slot to urge said inner jaw toward or away from said valve-closing cam lobe responsive to movement of said wedge in said slot.

2. A rocker assembly in accordance with claim 1 wherein said first follower is a roller.

3. A rocker assembly in accordance with claim 1 wherein said second follower is a slider.

* * * * *